United States Patent [19]

Noll

[11] Patent Number: 4,968,221

[45] Date of Patent: Nov. 6, 1990

[54] INTAKE VALVE FOR VACUUM COMPRESSOR

[75] Inventor: Lawrence G. Noll, Minster, Ohio

[73] Assignee: Dresser Industries, Inc., Dallas, Tex.

[21] Appl. No.: 332,804

[22] Filed: Apr. 3, 1989

[51] Int. Cl.[5] ..... F04B 49/02

[52] U.S. Cl. ..... 417/295; 137/492.5; 137/625.33; 137/907

[58] Field of Search ..... 417/295, 559; 137/513.7, 516.25, 494, 492.5, 625.33, 907

[56] References Cited

U.S. PATENT DOCUMENTS

| | | | |
|---|---|---|---|
| 2,556,623 | 6/1951 | Lipkau | 230/24 |
| 2,938,538 | 5/1960 | Allen | 137/516.25 X |
| 2,961,147 | 11/1960 | Osterkamp | 230/9 |
| 3,085,589 | 4/1963 | Sands | 137/516.25 X |
| 3,602,610 | 8/1971 | Bloom | 417/12 |
| 4,070,001 | 1/1978 | Musgrove | 137/907 X |
| 4,108,134 | 8/1978 | Malec | 137/516.25 X |
| 4,193,742 | 3/1980 | Fischer | 417/295 |
| 4,366,834 | 1/1983 | Hanson et al. | 417/295 X |
| 4,483,667 | 11/1984 | Berges | 418/84 |
| 4,621,544 | 11/1986 | Re | 137/494 X |

FOREIGN PATENT DOCUMENTS 2323458 11/1974 Fed. Rep. of Germany ..... 417/295

OTHER PUBLICATIONS

"Compressor-General"-Two Pages.

Article "Description of Vacuum Control System", 4 Pages.

*Primary Examiner*—Stephen M. Hepperle

[57] ABSTRACT

An improved valve assembly (100) is disclosed for use in a vacuum system (10). The valve assembly is provided with a valve (116) which is movable between a first position and a second position. In the first position, the vacuum reservoir (12) is isolated from the vacuum pump (14). In the second position, the valve permits air to flow from the vacuum reservoir to the vacuum pump only through metering ports (114). The valve assembly reduces the horse power requirement for initial start up of the vacuum system by restricting air flow from the vacuum reservoir to the vacuum pump. Also, an immediate vacuum is created in the valve assembly on start up to return oil from a separator (16) to the pump (14).

2 Claims, 3 Drawing Sheets

INTAKE VALVE FOR VACUUM COMPRESSOR

TECHNICAL FIELD

This invention relates to a vacuum compressor, and in particular to an intake valve permitting a lower horsepower motor to be used for a given compressor rating.

BACKGROUND OF THE INVENTION

There are many uses for a vacuum source throughout society. Among the most common are uses in hospitals and paper mills.

In a typical installation, a large capacity vacuum tank will be maintained at a predetermined vacuum by a vacuum compressor. As the pressure rises in the tank during use, the vacuum compressor draws down the vacuum to the desired set point.

In many applications, the demand for the vacuum tank is non-continuous. For example, in a hospital the tank may see extensive use during the daylight hours, but be essentially unused through the night. Therefore, the compressor requires a control system which permits air to be pumped from the tank only when necessary. A typical control system uses a valve which closes off the connection between the tank and compressor to prevent air flow through the compressor. While the compressor may be operating on a continuous basis, because it is not compressing air when the valve is closed, very little energy is required.

When the system is first installed, and at periodic maintenance or service intervals, the tank will be at or near atmospheric pressure. When operations are to begin anew a severe strain is put on the vacuum compressor during this initial startup because the vacuum is essentially lost from the tank.

Traditionally, the industry has resolved the initial startup problem by putting a larger horse power motor, and perhaps an uprated vacuum compressor, to rapidly reduce pressure in the tank to the desired vacuum. However, during normal operations of the vacuum system, this excess horse power and capacity is usually unnecessary.

SUMMARY OF THE INVENTION

In accordance with one aspect of the present invention, a valve is provided for use with a vacuum reservoir to be maintained at a set vacuum and a vacuum pump to maintain the set vacuum. The valve includes a valve casing defining a reservoir cavity, a pump cavity, and an intermediate cavity. An inlet port connects the reservoir cavity with the intermediate cavity. An outlet port, and at least one metering port, connects the pump cavity with the intermediate cavity. A valve is movable between a first position sealing against the casing to close the inlet port and a second position sealing against the casing to close the outlet port. Operation of the vacuum pump when the vacuum reservoir pressure exceeds the set vacuum draws the valve into the second position, closing the outlet port to establish an immediate vacuum in the pump chamber. The valve allows the pump to draw a vacuum in the intermediate cavity, reservoir cavity, and vacuum reservoir through the metering port. A closing mechanism is provided to move the valve toward the first position when the vacuum in the vacuum reservoir is at the set vacuum.

BRIEF DESCRIPTION OF THE DRAWINGS

For a more complete understanding of the present invention, and the advantages thereof, reference is now made to the following description taken in conjunction with the accompanying drawings in which.

DETAILED DESCRIPTION

Figure 1:
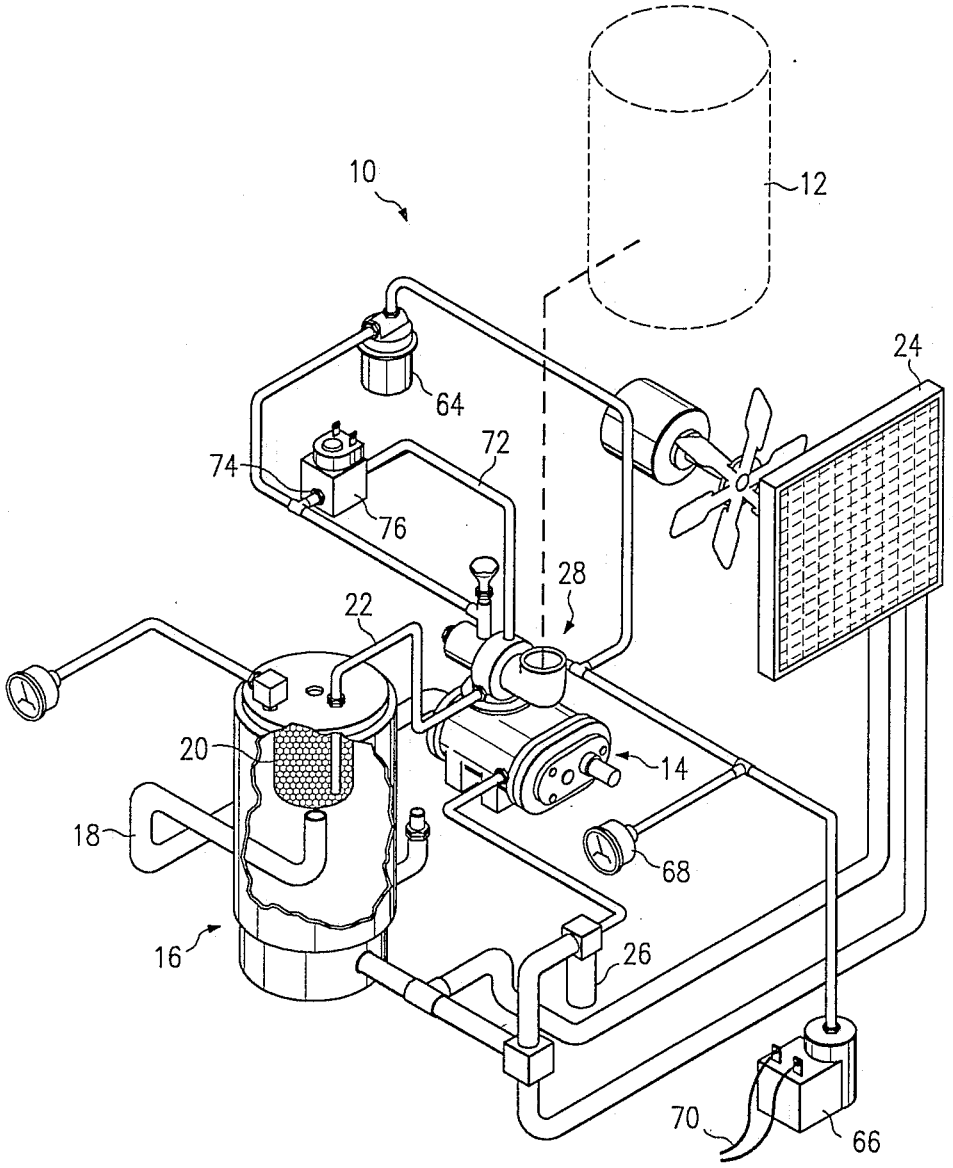
FIG. 1 is an illustration of a vacuum system of the type for which the present invention is intended.

With reference now to FIG. 1, there is shown a vacuum system 10 which has a vacuum reservoir 12 and a vacuum pump or compressor 14 to maintain a preset vacuum in the reservoir despite the demands placed on the reservoir.

The vacuum system 10 is of the type having a pump 14 which mixes oil with the air or other gas being pumped (hereafter, air will be used to generically refer to any type of gas for which the present invention is suitable). In operation, air is pumped from the reservoir 12, mixed with oil in the pump 14 and pressurized to at least atmospheric pressure for discharge from a separator 16. The high pressure outlet line 18 from the pump takes the air/oil mixture into separator 16 where it impinges on the bottom of the oil separator element 20. Most of the oil separates from the air at that point and flows to the bottom of the separator to a reservoir. The air and remaining entrained oil is separated as the air flows through the element 20 to discharge to the atmosphere. The separated oil collects at the bottom of the separator element 20 and is returned to the inlet of the pump through a scavenger line 22. The oil from the reservoir in the separator will flow through an oil cooler 24, and oil filter 26 before returning to the inlet of the pump. The oil is mixed with the air to cool the air, assist sealing action in the pump and lubricate the pump and its bearings. When a screw type pump is used, the oil assists the sealing action between the screws and mating threads.

Figure 2:
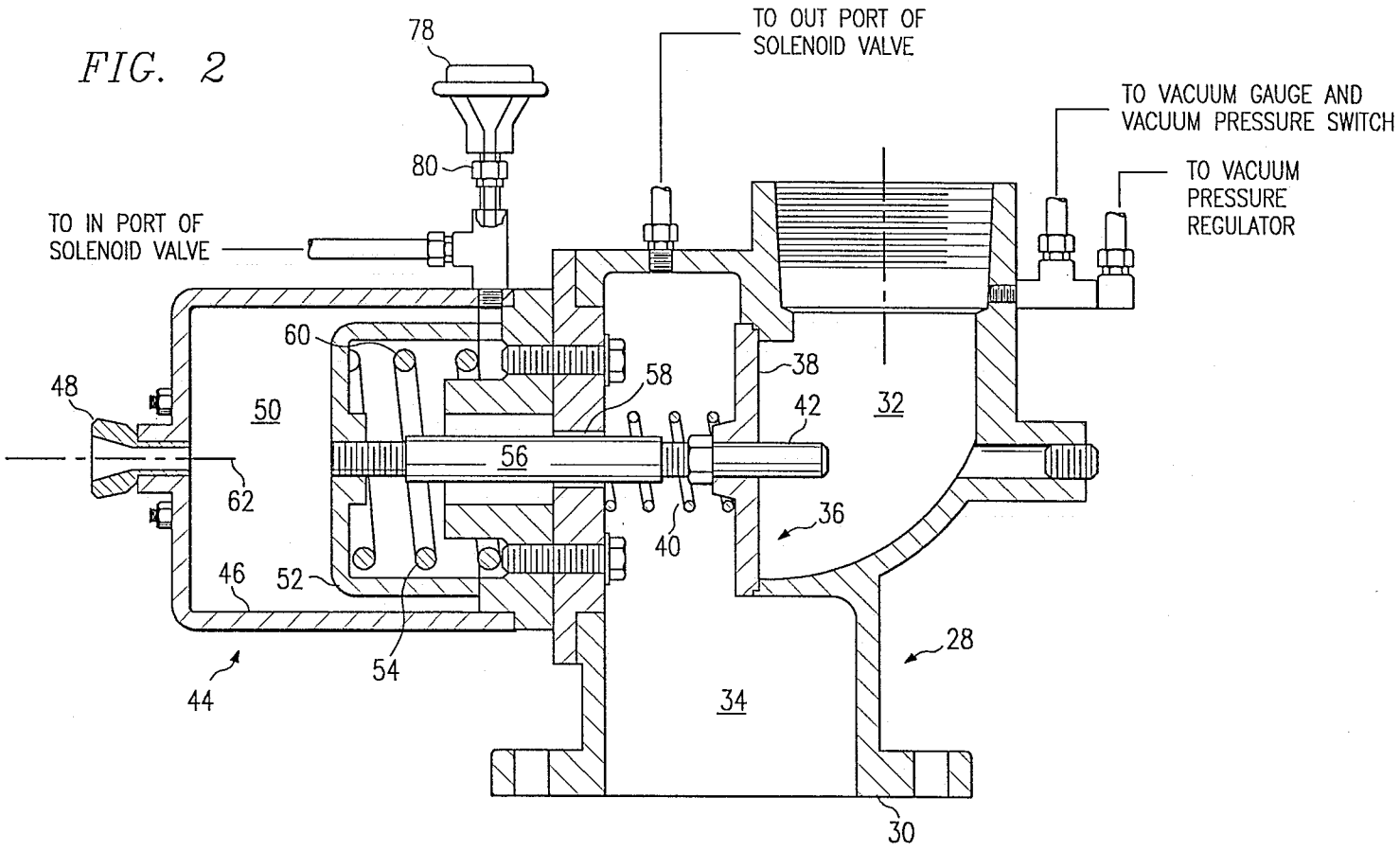
FIG. 2 is a vertical cross sectional view of a prior art intake valve.

With reference now to FIGS. 1 and 2, the control of the vacuum in the reservoir 12 will be described. Typically, a minimum permissible vacuum will be chosen, for example 22 inches of Hg, and a maximum vacuum will be chosen, perhaps 24 inches of Hg. It is therefore the task of the system 10 to maintain the reservoir 12 at a vacuum between 22 and 24 inches of Hg. The vacuum system includes an inlet valve assembly 28 which has a housing 30 defining a reservoir cavity 32 and a pump cavity 34. The cavities are interconnected by a port 36. An inlet valve plate 38 is urged against the housing 30 to close port 36 by a spring 40. The plate 38 has a hole which receives an inlet valve shaft 42 which is connected to an air cylinder 44.

The air cylinder 44 includes a rigid case 46 with a small orifice 48, perhaps 0.08 inches in diameter, connecting the external atmosphere to the cavity 50 within the case. A diaphragm 52 is mounted within the case 46 so that one side of the diaphragm is exposed to cavity 50, while the other side of the diaphragm 52 defines a chamber 54 isolated from cavity 50. A rod 56 is attached to the diaphragm 52 and extends out of chamber 54 through a seal 58 into the pump cavity 34. The inlet valve shaft 42 is adjustably threaded to the end of the rod 56. A spring 60 acts between the housing 30 and the diaphragm 52 which urges the rod to the left, as shown in FIG. 2, along axis 62 of the rod 56.

The reservoir cavity 32 is connected to a vacuum pressure regulator 64, a vacuum pressure switch 66 and a vacuum gauge 68. The vacuum gauge 68 provides a visual confirmation of the vacuum in the reservoir cavity 32 and vacuum reservoir 12. The vacuum pressure switch 66 is a normally closed switch which only opens if the vacuum in the reservoir cavity reaches the maximum vacuum; in the example 24 inches. Once opened, the contact will close only when the vacuum reaches the minimum vacuum, 22 inches. The vacuum pressure regulator 64 connects the reservoir cavity 32 to the chamber 54 in the air motor 44. Because atmospheric pressure is always present in cavity 50 and a vacuum will generally exist in chamber 54, the diaphragm 52 will be urged by this pressure differential in a direction opposite the force of spring 60. A line 72 connects chamber 54 to the pump cavity 34 through an orifice 74, having a diameter for example of 0.032 inches, and a solenoid valve 76. The solenoid valve 76 is a normally open valve controlled by the vacuum pressure switch 66. The chamber 54 is also connected to the atmosphere through a filter 78 and an orifice 80 of smaller diameter than orifice 74, for example 0.024 inches.

If the vacuum system 10 is shut down, for example for maintenance, atmospheric air will flow into chamber 54 to equalize the pressure between cavity 50 and chamber 54, allowing the spring 60 to move rod 56 to the left most position. In that position, the valve plate 38 could slide along the shaft 42 away from port 36, but for the action of spring 40, and the relative pressure differential between cavities 32 and 34. The vacuum in the reservoir cavity 32 may have decreased. However, as pump cavity 34 will more quickly move to atmospheric pressure through air flow from chamber 54 into cavity 34 through the normally open solenoid valve 76, plate 38 will act as a check valve to close port 36 to maintain whatever vacuum is present in the reservoir 12.

When the system is again activated, the vacuum pump 14 begins to pump air from cavity 34 to the atmosphere. Also, electric power is routed through the closed contact 70 in switch 66 to the solenoid valve 76 to close the valve 76. The vacuum created in cavity 34 causes the plate 38 to move against the force of spring 40 to open port 36 and draw air from the reservoir 12. As noted previously, if the reservoir 12 is near atmospheric pressure, a large horse power motor is necessary to operate the vacuum pump 14 to draw the vacuum reservoir 12 from atmospheric pressure to the desired vacuum This operation continues until the vacuum in the reservoir 12 reaches the minimum set vacuum, 22 inches.

At the minimum set vacuum, the vacuum regulator 64 begins to operate. The regulator permits a vacuum to be created in chamber 54 to operate the air cylinder 44 to drive rod 56 toward plate 38 to begin closing the port 36. As the valve plate 38 gradually closes port 36, an equilibrium condition can exist where the amount of air permitted into the vacuum pump 14 is equal to the amount of air being leaked into the vacuum reservoir 12 by use. However, if the vacuum pump continues to draw air at a rate greater than the usage of the vacuum reservoir 12, the vacuum reservoir 12 will eventually reach the maximum vacuum, 24 inches of Hg. At that vacuum, vacuum pressure switch 66 opens its contact, thus permitting the solenoid valve 76 to open. This permits air to flow from chamber 54, through orifice 74, to the pump cavity 34 to overcome the force of the spring 60 and move valve plate 38 over port 36 to close the inlet valve completely. When the vacuum level in the vacuum reservoir 12 decreases to the minimum set vacuum, 22 inches, the vacuum pressure switch 66 closes, closing solenoid valve 76 and permitting regulated opening of the valve plate 38 to again draw air from the vacuum reservoir 12.

An inlet assembly valve of the type identified by reference numeral 28 is sold as part No. 125370-001 by the Quincy Compressor Division of Colt Industries, Inc., 430 Park Avenue, New York, N.Y. 10022.

Figure 3:
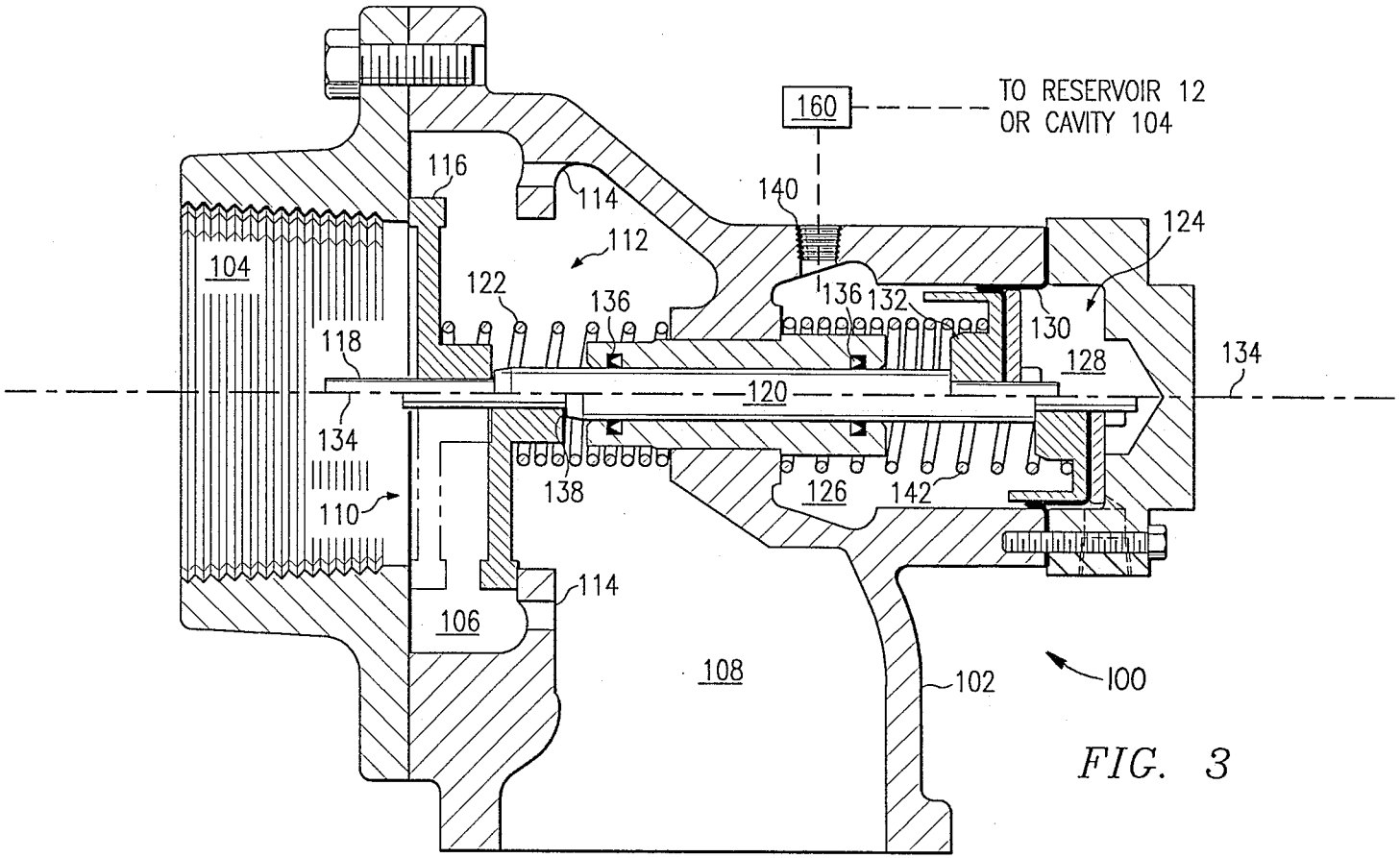
FIG. 3 is a vertical cross sectional view of a first embodiment of the present invention.

With reference now to FIG. 3, a valve assembly 100, forming a first embodiment of the present invention, will be described. The valve assembly 100 can be substituted for the valve assembly 28. The valve assembly 100 reduces the horse power required on the initial startup of the vacuum system by controlling the pressure at the inlet of the vacuum pump to maintain the low horse power requirement. Because a lower horse motor is necessary, the capital cost of the entire vacuum system 10 will be lowered.

The valve 100 includes a casing 102 which defines a reservoir cavity 104, an intermediate cavity 106 and a pump cavity 108. The reservoir cavity 104 and intermediate cavity 106 are connected by an inlet port 110. The intermediate cavity 106 and pump cavity 108 are interconnected by an outlet port 112 of size roughly equivalent to the inlet port 110, and a plurality of smaller metering ports 114.

A valve 116 is movable on shaft 118 of a rod 120 between a first position, shown in solid line in the upper half of FIG. 3, closing the inlet port 110, to a second position shown in solid line on the lower half of the drawing, closing outlet port 112. A spring 122 acts between the casing 102 and valve 116 to urge the valve into the first position.

The casing 102 defines a control cavity 124 which is separated into a vacuum chamber 126 and an atmospheric chamber 128 by a diaphragm bellows 130. The end of rod 120 opposite the shaft 118 mounts piston 132 which is connected to the bellows 130. The rod 120 is supported in the casing for movement along axis 134. The cavity 124 is isolated from pump cavity 108 by seals 136. A spring 142 urges the rod to the right as seen in FIG. 3. A seal 138 is provided at the transition from shaft 118 to the remainder of rod 120 to seal against the down stream side of the valve 116. A vacuum pilot valve connection 140 opens into the vacuum chamber 126.

If the vacuum system is shut down, the pressure in the vacuum reservoir 12 and cavity 104 may approach atmospheric pressure. The action of spring 122 holds the valve 116 in the first position to close inlet port 110 to maintain vacuum in the vacuum reservoir as long as possible.

When the vacuum pump is started, an immediate vacuum is created in pump cavity 108 which draws the valve 116 to the second position against the force of spring 122 to close the outlet port 112. The metering ports 114 then provide the only air path for air flow from the vacuum reservoir to the pump cavity, and the metering ports 114 allow only a controlled amount of air flow into the vacuum pump, eliminating the large pumping requirements necessary in prior designs when initial startup operation begins.

When the vacuum in the vacuum reservoir 12 and reservoir cavity 104 reaches a preset maximum vacuum for operation, a vacuum is created in the vacuum cavity 126 by a vacuum pressure regulator 160, which controls the vacuum system at least as effectively as the prior design, but eliminates the need for a solenoid valve or vacuum switch such as valve 76 and switch 66. The regulator does not allow a vacuum into port 140 until the minimum vacuum is reached. Between the minimum and maximum vacuums, the regulator allows a vacuum to exist in cavity 126 to the degree necessary to properly regulate valve 116. At the maximum vacuum, the regulator assures the valve remains closed. The position of valve 116 is thereby regulated, and the elements of valve assembly 100 operated to regulate the vacuum.

The valve assembly 100 has the further advantage of allowing a vacuum to be established in the pump cavity 108 immediately upon operation of the vacuum pump 14. This creates a significant pressure differential between the separator and the vacuum pump, drawing oil into the pump through the oil return line. This resists a tendency for the oil to be driven from the separator with the air discharged from the separator. As will be appreciated, the prior design did not establish such a pressure differential for a significant period of time after initiation of vacuum pump operation because the pressure at the pump inlet is substantially equal to the reservoir pressure and that entire volume must be evacuated to establish such a differential.

Preferably, the oil return line in the present invention does not connect directly to the air inlet of pump 14, but to the pocket of the pump that exists in a screw type pump when the screws have been rotated enough to close off the pocket from the air inlet and form a closed pocket. The vacuum in the pump cavity is also present in the pocket before the screws close off the air inlet, and the vacuum in the pocket, which is then closed, draws the oil from the separator into the pocket. This has several advantages. By returning the oil into the closed cavity after compression has already begun, the oil does not heat the inlet air before compression. Of course, heating air causes its pressure to increase. Thus, the prior design, in returning hotter oil to the air in the pump inlet, actually increases the air pressure and decreases the air density of the air entering the pump, which reduces the mass of air pumped for each pumping stroke and thereby lengthening the time necessary to pump out the desired quantity of air.

While one embodiment of the present invention has been illustrated in the accompanying drawings, and described in the foregoing Detailed Description, it will be understood that the invention is not limited to the embodiment disclosed, but is capable of numerous rearrangements, modifications and substitutions of parts and elements without departing from the spirit of the invention.

I claim:

1. A valve assembly for use with a vacuum reservoir to be maintained at a set vacuum and a vacuum pump to maintain the set vacuum, comprising:

a valve casing defining a reservoir cavity, pump cavity and intermediate cavity, the reservoir cavity connected to the intermediate cavity through an inlet port, the pump cavity and intermediate cavity connected through an outlet port and at least one metering port;

a valve movable between a first position sealing against the casing to close the inlet port and a second position sealing against the casing to close the outlet port, operation of the vacuum pump when the vacuum reservoir vacuum is less than the set vacuum drawing the valve into the second position to establish a vacuum in the pump cavity and draw a vacuum in the intermediate cavity, reservoir cavity and reservoir through the metering port.

2. The valve assembly of claim 1 wherein the valve assembly further comprises a closing mechanism for moving the valve toward the first position when the vacuum in the vacuum reservoir is at the set vacuum.

* * * * *